US005992104A

United States Patent [19]

Hudak

[11] Patent Number: 5,992,104

[45] Date of Patent: Nov. 30, 1999

[54] STRUCTURAL PROTECTION ASSEMBLIES

[75] Inventor: David Bruce Nesseth Hudak, North Vancouver, Canada

[73] Assignee: International Hydro Cut Technologies Corporation, North Vancouver, Canada

[21] Appl. No.: 08/644,175

[22] Filed: May 10, 1996

[51] Int. Cl.[6] ..... E04B 1/98; E02D 29/00

[52] U.S. Cl. ..... 52/167.1; 52/169.2; 405/211

[58] Field of Search ..... 52/167.1, 169.1, 52/169.2; 405/211, 258

[56] References Cited

U.S. PATENT DOCUMENTS

| | | | |
|---|---|---|---|
| 4,512,683 | 4/1985 | Cosenza | 405/211 |
| 5,173,012 | 12/1992 | Ortwein et al. | 405/258 |
| 5,174,082 | 12/1992 | Martin et al. | 405/258 |

*Primary Examiner*—Michael Safavi
*Attorney, Agent, or Firm*—Kolisch Hartwell Dickinson McCormack & Heuser

[57] ABSTRACT

An assembly having a flexible enclosure, filled with a suitable pressure wave attenuating medium material having a lower acoustic impedance than water so as to reflect shock wave energy. This basic configuration can be mounted in the form of panels and attached to the structure it is intended to protect, in which case it will form a flexible barrier of low acoustic impedance and be orientated between the structure and the water or ground in contact with the structure. The pressure absorbing and attenuating medium that will reflect shock waves may be a gas, compressed air, a closed cell foam or expanded foam. The flexible enclosure may be made of rubber or plastic or elastomer. For certain types of foaming agents, the outer skin will harden into a suitable enclosure so that no discrete shell or enclosure is necessary.

10 Claims, 13 Drawing Sheets

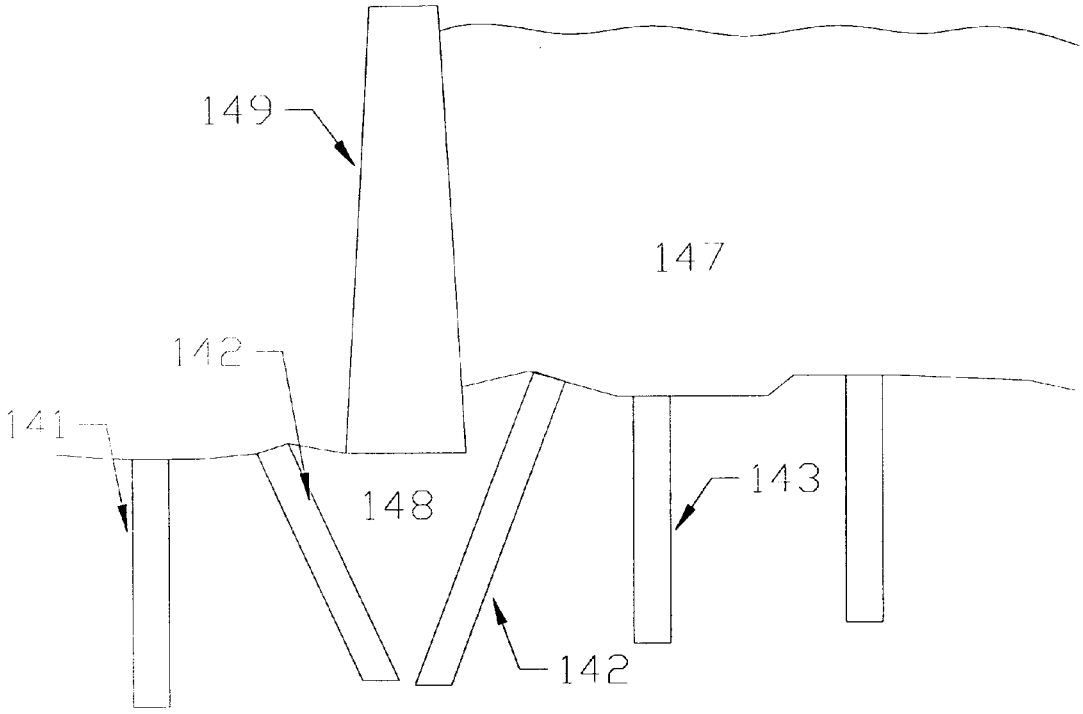
FIG. 14(a)
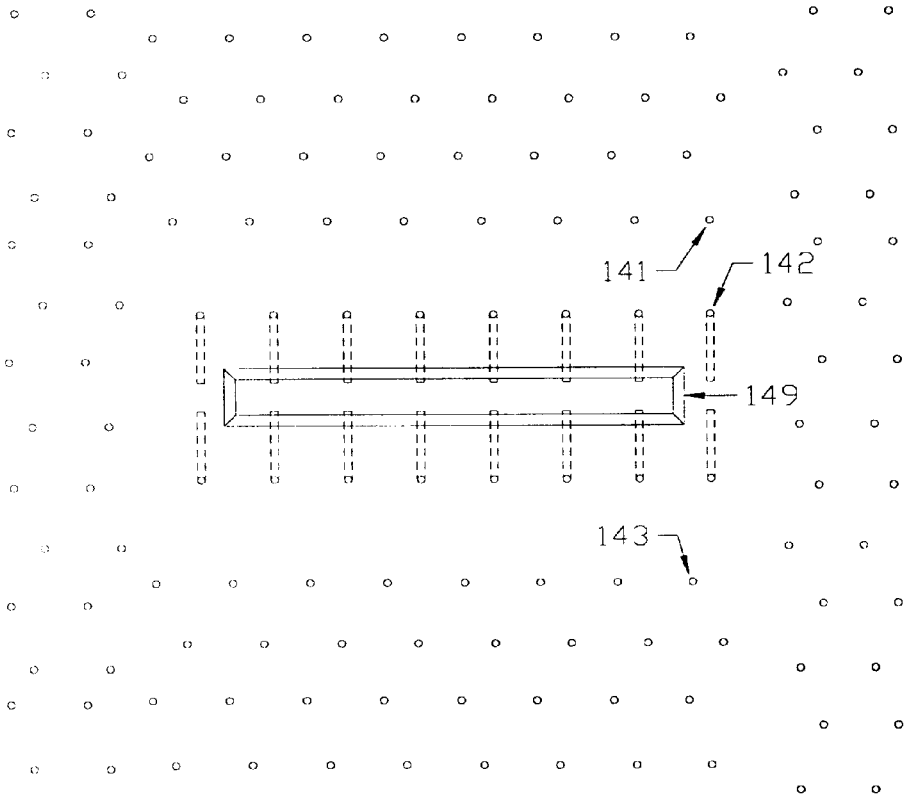
FIG. 14(b

STRUCTURAL PROTECTION ASSEMBLIES

FIELD OF THE INVENTION

This invention relates to the protection of structures against pressure phenomena.

BACKGROUND OF THE INVENTION

Sometimes, stress builds within the earth to such a significant level that it must be relieved, typically by rupture or failure of material. This rupture, an earthquake, may release enormous amounts of energy in the form of heat and seismic waves and may result in significant displacement of land masses at the surface. During an earthquake, a very significant amount of energy is released in a period of time that may range from a fraction of a second to several seconds. This energy release can be compared to detonating a large explosive charge underground, as the effects of both share several similarities. Energy released quickly during such events, produces a pressure pulse which radiates from the point of origin as stress waves. The size, profile and depth of the energy release area has an important bearing on the frequency of the vibrations. In the case of underground explosive detonations, if the release area is larger, and/or deeper, the frequency will be lower. If the release area is smaller, and/or closer to the surface, the frequency will be higher.

A pressure wave may move sonic or supersonic through the material it transits. A shock wave refers only to a pressure wave which moves faster than the sound speed of the material through which it transits. In this document, "stress waves" refer to pressure waves transiting a material at the sonic velocity of that material, and "shock waves" refers to pressure waves transiting a material above the sonic velocity of that material. Pressure waves and shock waves are traveling pressure fluctuations which cause local compression of the material through which they transit. Stress waves cause disturbances whose gradients, or rates of displacement are small on the scale of the displacement itself. Stress waves travel at a speed determined by the characteristic of a given medium and therefore must be referred to a particular subject medium.

Shock waves are distinguished from stress waves in two key respects. First, shock waves travel faster than the sonic velocity of the medium through which they transit. Secondly, local displacements of atoms or molecules comprising a medium that is being transited by a shock wave are much larger than those produced by stress waves. Together, these two factors produce gradients or rates of displacement much larger than the local fluctuations themselves.

Energy is required to produce pressure waves and once the driving source ceases to produce the stress disturbances, the waves decay. Absorption and attenuation involve acceleration of the natural damping process, which therefore means removing energy from the pressure waves. All matter through which pressure waves travel, naturally attenuate these waves by virtue of their inherent mass. Materials possess different acoustic attenuating properties, strongly affected by density and the presence or absence of phase boundaries and structural discontinuities. For example, porous solid materials are better attenuators of stress waves than perfect crystalline solids.

Acoustic impedance is the product of a material's sonic velocity multiplied by the material's mass per unit area. A material's acoustic impedance indicates how well it will transmit pressure waves. The higher the value, the greater (higher amplitude and/or higher velocity) the stress transmission in that particular material. Water has a density of 1 gram/cc, while air has a density of 1/1000 that of water. Water has a sonic velocity of approximately 1650 meters per second and air has a sonic velocity of 344 meters per second. The ratio between the acoustic impedance of water to air is nearly 4,800. Different types of rock will have varying sonic velocities due to differences in densities, crystallographic structure and the presence of discontinuities.

During a large explosion in a solid (such as rock), and during an earthquake, the resultant pressure pulse is a series of waves. There are two main types of body waves originating from the interior of the solid, which have different particle motions and velocities. The first wave to arrive (i.e. fastest), at a given point from the origin of the energy release, is a compressional wave, usually called a "P-wave". The particle motion in the P-wave is a "push-pull" motion, radially away and toward the origin, or in other words parallel to the direction of wave propagation. The other wave is a shear wave, usually referred to as an "S-wave". S-waves are generally transversal waves and the article motion is perpendicular to the travel path. S-waves and other waves will arrive after the P-wave because they are slower. P-waves and S-waves are both volume waves since they propagate in a three-dimensional space. At interfaces between different media (for instance, at interfaces between ground and air, between ground and water or between layers of ground of very different elastic characteristics), different types of surface waves are developed.

During an earthquake, when the P-waves and S-waves arrive at the ground surface, other waves are also developed. The two primary surface waves are known as "Love waves" and "Rayleigh waves".

The first, and faster of the two, are Love waves, whose motion is essentially the same as that of S-waves without vertical displacement. Love waves move the ground from side to side in a horizontal plane parallel to the earth's surface but transverse to the direction of propagation. The second, most prominent and common surface waves, are Rayleigh waves, or "R-waves" (elastic wave). P-waves, S-waves and R-waves produce vertical motion, whereas Love waves produce only horizontal motion. Rayleigh waves, because of their vertical component of motion, can affect bodies of water such as lakes, whereas Love waves (which do not propagate through water) can affect surface water only at the sides of lakes, water reservoirs and ocean bays, by a movement backwards and forwards, pushing the water sideways like the sides of a vibrating tank. The Love surface waves are the third to arrive because they travel slower than P-waves and S-waves. In the Rayleigh wave, the particles are described in a retrograde elliptical motion. The vertical component of the particle motion as its maximum just below the surface, but thereafter diminishes relatively rapidly with depth. Rayleigh waves may be compared to waves generated when a rock is thrown into a pond.

Because the various waves travel at different velocities, the differences in their arrival times at the land mass depend on the distance traveled from their origin. Very near the origin, the waves are mixed and are indistinguishable from one another.

As the distance from the point of origin increases, the waves separate and it is possible to see the differences in their characteristics. If all three wave types are well developed, the P-wave has the highest frequency and the smallest particle motion; the S-wave has a lower frequency and larger particle motion; and the R-wave has a frequency still lower and a particle displacement that is still larger in amplitude.

Propagation of Elastic Waves

The elasticity of a homogeneous, isotropic solid can be identified by two constants, k and $\mu$.

k is the modulus of incompressibility or bulk modulus $$\alpha = \sqrt{\frac{\left(k + \frac{4}{3}\mu\right)}{\rho}} \tag{1}$$

for granite, k is about $27\times10^{10}$ dynes per $cm^2$ for water, k is about $2.0\times10^{10}$ dynes per $cm^2$ $\mu$ is the modulus of rigidity $$\beta = \sqrt{\frac{\mu}{\rho}} \tag{2}$$

for granite, $\mu$ is about $1.6\times10^{11}$ dynes per $cm^2$ for water, $\mu$ is 0

Within the body of an elastic solid with a density ρ, two elastic waves can propagate:

| |
|---|
| P-waves Velocity |
| for granite, α = 5.5 km/sec |
| for water, α = 1.5 km/sec |
| S-waves Velocity |
| for granite, β = 3.0 km/sec |
| for water, β = 0.0 km/sec |

Along the free surface of an elastic solid, two surface elastic waves can propagate:

Rayleigh waves Velocity $C_r<0.92\ \beta$ where β is the S wave velocity of rock.

Love waves (for layered solid) Velocity $\beta_1<C_L<\beta_2$ where $\beta_1$ and $\beta_2$ are S-wave velocities of the surface and deeper layers, respectively.

The dimensions of a harmonic wave are measured in terms of period T and wavelength λ.

$$\text{Wave velocity } v=\lambda/T \tag{3}$$

$$\text{Wave frequency } f=1/T \tag{4}$$

As a particle vibrates, its motion can be described in several different ways. It moves a certain distance from its resting position, which is termed "displacement". It moves in a repetitive cycle or oscillation a certain number of times each second, which is termed frequency, and is usually expressed in Hertz. Displacement alone does not express the intensity of a motion.

Something can move a great distance very slowly and not be damaged by that displacement. To assess damage potential, the rate or velocity of the displacement must be taken into account.

For simple harmonic motion, the relationship between displacement, frequency and velocity allows calculation of any of the three if the other two are known.

$$V=2\pi f D \tag{5}$$

where V=peak particle velocity in inches per second (ips)

π=3.14 f=frequency in Hertz (cycles per second)

D=maximum displacement (inches)

also T=period=1/f and 2 πf=the circular frequency or angular velocity of the particle Hence, D=V/2 πf and f=V/2 πD As mentioned earlier, a shock wave is a pressure wave which is transiting a material at a speed greater than its sonic velocity. This wave produces an abrupt pressure "jump" in the material. $U_s$ (shock velocity)>$C_B$ (bulk sound velocity), which means that $U_s$ is supersonic with respect to the material (in its initial state). Compressional shock waves act to accelerate the particles of a material in the direction of wave propagation. On the other hand, rarefraction waves (expansion, unloading waves) act to accelerate the particles of a material in the opposite direction of wave propagation. Rarefraction waves may also be known as reflection waves, as they are a result of a compression wave being reflected back towards its point of origin as a tensile wave.

In the case of shock waves, jump relations (which describe the changes across the shock front) are obtained from the conservation of mass, momentum and energy, known as equations of state or E.O.S. The Rankine-Hugoniot E.O.S. for shock waves are:

$$\text{Mass: } \rho_0 U_s=\rho_1(U_s-up) \tag{6}$$

$$\text{Momentum: } P_1-P_0\rho_0 U_s up \tag{7}$$

$$\text{Energy: } p_1 up = \rho_0 U_s\left(E_1 - E_0 + \frac{up^2}{2}\right) \tag{8}$$

When $p_1>>p_0$, Equations (5) and (6) combine to give $$up^2 \approx E_1 - E_0 + \frac{up^2}{2} \text{ or } E_1 - E_0 \approx \frac{1}{2}up^2. \tag{8a}$$

During an earthquake structurally damaging energy may be transmitted through the ground at speeds higher than four kilometers per second. Ground motions from earthquakes are characterized by large displacements, low frequencies and long durations. Stress waves will be transmitted from the earth into a body of water and then traverse the body of water until they encounter another medium or material (which may be a structure).

When this stress wave hits a structure, it imparts particle velocity into the materials of the structure.

The term "coupling" describes the interface between two different (dissimilar) materials. The amount of coupling between materials is a function of area joining the different materials, the bond between the two materials, and a function of the respective a acoustic impedances of the two materials, as well as the direction of displacement of the stress waves.

As a spherical shock wave is transmitted into the medium departing from the point of origin (energy release) the shock wave amplitude and energy decrease with distance. For very high shock pressures, the deformation of the material accompanying the one-dimensional shock compression is plastic. But as the shock propagates radially from the point of origin, the amplitude decreases very quickly and soon reaches the limit termed the Hugoniot elastic limit (HEL). From then on, the deformation is purely elastic. Such elastic compression waves are stress wave, and they propagate at the sonic velocity of the material being transited.

When the stress wave travels into a new medium with a different acoustic impedance, part of the energy will be reflected and another part will be transmitted. Pressure within a structure will be called stress rather than pressure, and will be designated "σ". To reiterate, the impedance of a medium is given by the product of the density ρ and the sonic velocity c. Consider an elastic infinite medium through which a plane stress wave passes. The stress induced $\sigma_1$ is the product of the density $\rho_1$, the sound velocity $c_1$, and the particle velocity $v_1$, $$\sigma_1=\rho_1 c_1 v_1 \tag{9}$$

which clearly stems from the conservation of momentum M (equation 7) in the Rankine-Hugoniot E.O.S. In general, if a plane compressive stress wave reaches a boundary which is not parallel to the wave front, four waves are generated. Two of these are reflected waves, moving back into the medium from which the original wave came, a shear wave and a compression or expansion wave; the other two waves, also a shear wave and an expansion or compression wave, are transmitted into the new medium.

Consider a simpler, special case when the stress wave has a normal incidence to the boundary. Then, a wave with stress level $\sigma_R$ and particle velocity $v_R$ is reflected back. Another wave is transmitted into the second medium which is assumed to have density $\rho_2$. It has stress level $\sigma_T$, particle velocity $v_T$, and shock wave velocity $c_2$.

According to equation (9), it follows that:

$$v_1 = \frac{\sigma_1}{\rho_1 c_1} \quad v_R = \frac{\sigma_R}{\rho_1 c_1} \quad v_T = \frac{\sigma_T}{\rho_2 c_2}. \tag{10}$$

The following conditions must be fulfilled assuming that the two materials are in contact with each other during the shock wave passage:

$$\sigma_1+\sigma_R=\sigma_T$$

$$v_1+v_R=v_T \tag{11}$$

Combining equations (10) and (11) gives the following expressions for the stress levels of the reflected and the transmitted waves:

$$\frac{\sigma_R}{\sigma_1} = \frac{1-\mu}{1+\mu} \tag{12}$$

$$\frac{\sigma_T}{\sigma_1} = \frac{2}{1+\mu} \tag{13}$$

$$\mu = \frac{\rho_1 c_1}{\rho_2 c_2}. \tag{14}$$

From equations (12) and (13), it is apparent that the ratio $\mu$ between the impedances varies. If the stress wave travels toward a medium with the same impedance ($\mu$=1), no reflection occurs ($\sigma_R/\sigma_1$=0).

When a stress wave passes from rock to air, or more specifically, from rock or water to air, gas or foam, ($\rho_1 c_1 >> \rho_2 c_2$), i.e., $\mu$ is very large, so almost no energy is transmitted. If $\rho_1 c_1 > \rho_2 c_2$, i.e., $\mu$>1, then the reflected compression wave will appear as a tensile wave. Finally, if $\mu$<1, then the reflected wave is a compression wave.

The relationship between vibrations and damage to a structure is complicated for many reasons. Some structures are more solidly built than others, and have different dimensions, materials, methods of assembly, and types of foundations. Moreover, the intensity, type, frequency range and wavelength of the vibrations, and the direction of incidence of the wave fronts relative to the main axis of the structure all play important parts in the origin of damage.

In concrete structures, such as a dam, two causes account for added stresses during an event like an earthquake: the acceleration of the mass of the structure and the changes of water pressures.

There are two distinct water pressures which affect a structure in contact with water and which actg simultaneously during an earthquake. The first is hydrostatic pressure (due to the depth) $P_1$, which is present before, during and after the earthquake. The second is hydrodynamic pressure (due to ground acceleration transferring energy into the water and the stress waves transiting the water and interacting with the structure) $P_2$, which is caused by the earthquake and is not normally present.

Hydrostatic Pressure (15)

$$P_1 = \zeta \times g \times h \cong ___kPa$$

where ζ=water density=1000 kg/m$^3$
g=gravity acceleration≅10 M/s$^2$
h=distance between water surface and lowest level of the structure Hydrodynamic Pressure (16)

$$P_2 = C_y \times a_h \times w \times h = \quad _kPa$$

where $C_y$=is a parabolic function of depth of water
$a_h$=peak horizontal ground acceleration from quake
w 32 specific gravity of water
h=height Total Pressure (17)

$$P_1 + P_2 \cong kPa \cong \text{atm.}$$

Hydrodynamic forces may be absorbed and attenuated very effectively through adiabatic compression of gas bubbles. As the pressure increases within the gas it will heat. The heat causes the gas to expand. If the pressure is still higher outside the bubbles, interface, it will be compressed again and then expand.

In the past various attempts have been made to protect structures from the effects of shock waves and stress waves from earthquakes, explosions and other large energy sources.

U.S. Pat. No. 5,174,082 shows material described as an "island" with mechanical properties different than that of the ground. The islands are anchored deep underground by cable. A variant listed is to inter-disperse wells 5 m to 30 m deep filled with a granular or pulverized material, among the islands.

U.S. Pat. No. 5,173,012 shows a vertical wall barrier between a rail line and a building. The barrier is intended to stop ground-borne noise and vibration from travelling through the ground. It is constructed of two parallel concrete walls with elastic mat sandwiched between the walls.

U.S. Pat. No. 4,484,423 teaches a trench intended to be as deep as possible (but at least 100 meters deep), installed near a ground based structure to be protected (perhaps 3–60 meters in the case of a conventional power station). The preferred fill in the trench is a liquid or other material with a low shear, or gas bags or other media which does not allow S-waves. This technique is obviously impractical for many reasons, especially in submarine applications involving a dam.

None of these prior techniques can protect a structure in contact with water or a submerged structure, from energy being transferred to it through the water. Further, these methods do not lend themselves to protecting the submarine portions of pre-existing structures from pressure waves.

Canadian Patent No. 2,699,117 asserts that in the context of submarine blasting, interposing an air curtain of reasonable density between the structure to be protected and the source of waves, the resulting pressures can be reduced by 90%.

U.S. Pat. No. 5,394,786 teaches the use of aqueous foam as a buffer medium to attenuate S-waves in the ground. Aqueous foam might be useful when attempting to attenuate S-waves in the ground but is of no use in submarine applications. No attenuation will be present in such applications because the impedance of the aqueous foam will be nearly identical to that of the water.

SUMMARY OF THE INVENTION

This invention relates to a cushion which creates a discontinuity of materials, by interposing the cushion in the ground or water between the structure and the oncoming pressure waves (stress waves and shock waves).

In one embodiment, the cushion is a container, whose outer boundary or enclosure is flexible, and which is filled with a medium that has a lower acoustic impedance than the water or ground which is in contact with the cushion. A suitable medium is porous foam. In this document, "porous foam" refers to closed cell foam (such as closed foam polyurethane) or expanded foam (such as expanded polyurethane) or a closed cell elastomer or other materials which have similar physical properties, such as having stably closed cells. The physical characteristics of the cushion with such a medium as porous foam, allow it to absorb and attenuate pressure waves and reflect compressive waves as tensile waves.

Generally, cushions according to the invention may be placed in water near submerged structures such as dams, sensitive portions of dams, bridge abutments, submerged tunnels, submerged pipelines, etc., to protect them from pressure and shock energy.

The cushions may be placed in the ground for protection of structures such as houses, buildings, bomb shelters, etc., from pressure and shock energy transmission through the ground.

The invention does not strengthen the structure to enable it to accommodate the energy imparted to it by an earthquake. It protects by creating physical differences seen by oncoming waves (by placing a medium between the structure and the water) which will reduce the actual stress imparted to the structure. The primary approach is to reduce the energy imparted onto a structure through its coupled interface with the water. The second approach is to reduce forces resulting from hydrodynamic pressures created by an earthquake.

Below is a summary of the active and passive embodiments of the invention.

STATIC (Passive)

Insulator/Energy Absorber Panels designed as flexible cells or containers filled with porous foam. These panels are attached to structures under the water. Once installed, these panels are always operational and little maintenance is required.

Fixed line bubble curtain suspension of spheres and/or cylinders filled with porous foam, that are suspended in a matrix located near the structure.

DYNAMIC (Active)

Bubble curtains, created through placement of piping, compressors, air reservoir tanks and related equipment which are arranged so as to be activated by sensors which detect incoming P-waves, in time to produce a complete bubble curtain upon the arrival of the S-waves.

Bubble curtains, created vis-à-vis the deflagration or burning of a chemical charge under the water which in turn produces gas bubbles. These charges are appropriately placed on a wire net to form a matrix. This system is triggered and initiated by sensors which detect incoming P-waves.

Insulator/Energy Absorber Panels

The panels may be a molded cell or container made of a polyurethane elastomer (or other flexible material) which is filled with porous foam or a gas or a vacuum.

The cell may be sandwiched between two plates. The two main concepts behind this approach are to create a low density medium which will cover the structure that is to be safeguarded, and to create a device that is capable of significantly attenuating hydrodynamic forces caused during an earthquake. Secondly, the design concepts of the sandwich type assembly of the cell between two plates may be utilized to provide external strengthening by increasing the thickness of a steel plate on the side of the panel which will be fastened to the structure. The outer plate of plastic is intended to make the assembly more rugged and protect from damage caused by objects such as logs, ice or boats. It should have an acoustic impedance similar to that of water. The shape of the outer plate (or the outer surface of the outermost panel) may be convex, irregular or have an array of pyramid-like projections, which serves to hydrodynamicaly orientate the panel to further attenuate the oncoming compressive waves.

Stress waves do not move well across dissimilar material boundaries where the wave is transiting the material of not only a higher density but more specifically of a higher acoustic impedance, and is trying to cross an interface boundary into a material with a significantly lower density, more specifically, a lower acoustic impedance. At this type of boundary interface, most of the compressional energy is reflected as a tensile wave back into the material of high density and high acoustic impedance. The amount of energy that crosses the interface boundary, versus the amount of energy reflected, is a function of the difference in acoustic impedance of the materials. The concept is to insulate the structure from the energy by reflecting it away in tension. By reducing the loading potential of the structure it is safeguarded.

The design of the insulator/energy absorber panels is intended to act as a compressible pressure absorber to dissipate energy through compression of the device during increases and/or oscillations of hydrodynamic pressures against the structure's surface.

The parameters of the panel may be adjusted to obtain optimal performance for the actual operating environment and anticipated pressure waves. For example, where a large displacement is expected, large volume panels are preferred. If high frequencies are expected (as may come from detonation of explosives), the pyramid-type array front surface is preferred.

The volume thickness of a polyurethane elastomer cell can be varied as required from a few inches to several feet. The material of the cell should have an acoustic impedance similar to that of water. A range of porous foam products or expanding foaming is available so that the porous form for the cell, can be adjusted for the desired density, compressibility, and recoverability (decompressing). The thickness of the steel plate nearest the structure can be varied to provide additional external support if required.

While the above explanation about the cell dealt with porous foam, utilizing convention technology, other mediums such as gas or a vacuum, are possible.

Passive & Active Bubble Curtains

Bubble curtains have been used in commercial blasting operations to protect underwater structures. Typically, for a commercial blasting operation, a bubble curtain generator is constructed by laying out runs of pipes on the marine bed proximate the origin of the blast but beyond the anticipated extent of the muck pile. The pipes are set up perpendicular to the axis between the origin of the expected blast and the structure. There may be three sets of pipes laid parallel on the marine bed and spaced a few feet apart. Each pipe will have a series of specific sized holes which will allow it to leak a volume of air as a function of particular sized bubbles. These pipes are fed by headers which in turn are attached to air tank reservoirs and compressor systems. The compressors fill large reservoir tanks. Before the blast is initiated, enough time must be allowed to let the headers charge with air, the system purge itself fully of water and to start to produce a curtain of air bubbles from the marine bed to the water surface. For commercial blasting operations the length of the curtain is usually inspected by a diver to verify the curtain is operating correctly before the blast is initiated.

The theory behind a bubble curtain is as follows. There are several ways the bubbles reduce energy from one side of the curtain to the other. The bubbles have a significantly lower density and acoustic impedance than the surrounding water. They are also spaced at irregular intervals, three-dimensionally. The significant difference of the bubbles' density and acoustic impedance allow it to reflect most of the compressive energy of the P-waves back as tensile waves. Additionally, the bubbles have the ability to expand and contract due to pressure changes.

The theory is that as the hydrodynamic pressure increases, the bubbles are compressed. This compression forms heat, and at a point the bubble will begin to expand. As the bubble expands, it loses its heat, and if the energy around the bubble is large enough it will be compressed again, and the cycle starts all over. This compression and expansion activity absorbs a tremendous amount of energy. It should be noted that the panels described above act in the same way to absorb and attenuate the compressive energy.

Fixed Line Suspension Bubble Curtain

This concept involves molding a series of various sized containers, which would in all likelihood be porous foam filled for reliability, and arranging these containers on increments spaced apart on fixed lines. Rows of fixed lines would then be anchored to the marine bed to form a matrix or curtain. The placement would also have to be close to the structure to minimize disturbances entering the water behind this fixed line suspension bubble curtain, between it and the structure. One important advantage of the static system, as with the panels, is that the system is ready to respond upon installation. There is no reaction time or ramp up time required to get the system on line and operational, and therefore there is less to go wrong.

Conventional Bubble Curtain

It is possible to engineer a conventional bubble curtain generator utilizing piping, headers, air tank reservoirs and compressors to reduce hydrodynamic forces acting on submarine structures. It must be understood, however, that considerable modifications to existing designs would have to be made for the system to be operational very quickly. To take a simplified example, that a bubble rises in water at one foot per second; and that the S-waves arrive three seconds after the P-waves. There is a seismic sensor to detect the incoming P-waves, which will activate the bubble curtain upon detection. The pipe array would have to be constructed with a spacing of less than three feet (according to the example above) for the bubble curtain to form up between each set of pipes before the arrival of the S-wave and other waves if only a conventionally developed bubble curtain were used. If a conventional bubble curtain was employed with another technology which could provide immediate protection during the ramp up time required to bring the conventional bubble curtain on line, then piping for the conventional bubble curtain would only be required at the marine bed.

Chemically Developed Bubble Curtain

The concept for a chemically developed bubble curtain is the same as for the other bubble curtains. The difference is that the bubbles would be produced by deflagrating or burning a chemical under the water. These chemical bubble generators or cartridges would have to be spaced on a wire mesh and various meshes arranged in an array, to produce an effective curtain. Spacing and similar criteria for the conventional bubble curtain apply to this concept as well.

The advantages of a chemically produced bubble curtain system are that installation would be very fast compared to the conventional bubble curtain mentioned above, and the initial equipment cost would be significantly lower as compressors and other associated hardware would not be required; only a seismic triggering system is necessary. In consideration of this concept, it is possible to have several circuits of these chemical bubble generators, so if the system had to be fired again due to an aftershock, it could do so a number of times. The obvious disadvantage of this system is that after it is used it must be replaced to recharge that section. It would be anticipated that the chemical cartridges would have a shelf life of between 5 and 10 years, after which the cartridges would have to be replaced.

Combining Technologies

Combining the above concepts will provide the best protection. The energy absorber panels will be attached to all or portions of the structure that are considered at high risk. In addition to the safeguarding effects of the panels, bubble curtain technologies would be applied appropriately. The bubble curtain systems may be configured as follows. A chemically developed bubble curtain array would be placed, as would the piping and associated hardware for a modified conventional bubble curtain system. Sensors would detect incoming P-waves and immediately initiate the chemically developed bubble curtain. The sensor package would also bring compressors on line to start pressurizing the conventional bubble curtain system. The intent of the chemically developed bubble curtain is to provide immediate protection for the structure during the ramp up time required to bring the conventionally produced bubble curtains on line. The conventionally produced bubble curtain would be permitted to run for as long as aftershocks were considered a hazard, which might be days or weeks. Fixed line suspension bubble curtains may be utilized at ultra sensitive areas to provide even greater protection.

To consider the example of a dam, the following terms will be used: "upstream" means above the dam towards the side that is watered (where the reservoir is); "downstream" means below the dam where the water would run down towards the ocean; "cross valley" means along the length of the dam from one anchored wall to the other anchored wall.

If an earthquake occurs downstream side, structurally damaging energy will be transmitted through the ground at the sound speed of the ground to the dam. The foundations of the dam are deep into the ground and therefore the ground and dam are well coupled. The acoustic impedance of the ground and dam are also quite close to each other and therefore energy transmitted through the ground will very easily cross the barrier or coupled surfaces between the ground and dam. The incoming energy will then accelerate the mass of the dam and displace it. Very little energy will be entering the face of the dam from the downstream energy source because air is a poor energy conductor.

When calculating the total energy into the dam, there is really only concern with the dam's coupled surface to the ground. This displacement of the dam's foundation and transfer of stress throughout the dam's structure will cause all parts of the dam to move—according to the Westergaard equations (for calculating total load on the dam's watered face), the dam is assumed to be moving as a whole at the same time and in the same direction. In the example, the energy source was downstream of the dam and therefore the dam will be accelerated and displaced in an upstream direction. This forces the watered face of the dam into the water currently being held in the reservoir. Since water is basically considered non-compressible, the result for any given point on the dam's watered face is that the pressure at that point will now be the sum of the hydrostatic pressure plus this newly developed hydrodynamic pressure which has been applied very quickly. This creates very significant loading on the structure and may in fact cause its subsequent catastrophic failure, or at least failure of some components of the entire structure such as gates and valves. By placing a layer of cushioning material between the water and the watered face of the dam, the hydrodynamic pressure is attenuated, reducing the loading on the structure. Further, by providing compressible assemblies (suspended chambers or air bubbles from the chemically developed air curtain or modified conventional bubble curtain piping), more of the water is allowed to be displaced into the area these are occupying—thereby absorbing its its compressive energy thus releasing it from the structure.

It should be pointed out that this example is different in several ways if the energy source originates upstream. First, the sound speed of the ground is higher than the sound speed of the water, and, the density of the ground will also be higher than that of the water. Therefore, when analyzing the acoustic impedance matching of the water and the ground, the water's acoustic impedance is less than that of the ground. Assuming two dissimilar materials are coupling sufficiently, compressive energy will transit(cross) the boundary between a material of a lower acoustic impedance into a material of higher acoustic impedance efficiently. If the energy is traversing a material of higher acoustic impedance and reaches a boundary condition with a material of lower acoustic impedance, then an amount of energy will be reflected into the material of higher acoustic impedance as a reflected wave in tension (a rarefraction wave).

The amount of energy rarefracted is a function of the differences in acoustic impedance. The greater the difference, the more energy is rarefracted. The energy is traveling through the ground from the earthquake's epicenter towards a water reservoir and dam from the upstream side. As the energy reaches the water, an amount of it will transfer into the water and therefore displace and accelerate the water as well. The energy in the ground is traveling at the sonic velocity of the ground and the energy in the water is traveling at the sonic velocity of the water. The dam will "see" the energy transmitted through the ground before it will see the energy transmitted through the water. The energy through the ground will displace the dam in a downstream motion. This will cause a sudden relief of hydrostatic pressure as the dam moves away from the water (because the arrival of the energy through the water has not yet arrived at the dam and therefore the water has not yet been displaced towards the downstream direction). The water will begin to move forward to close the gap area the dam has been displaced creating an inertial effect of the water. This inertial effect is one component of the hydrodynamic forces acting on the structure. At some point the dams forward displacement will stop and its direction will begin back towards the upstream direction. The movement of the structure back towards the water and the displacement forcing of the structure towards the upstream direct will also contribute to the hydrodynamic forces acting on the structure. Every structure has a natural frequency. It is necessary to consider the natural frequency of the structure as well as the displacement of the structure from ground acceleration, and as previously mentioned hydrodynamic forces acting on the structure all of which affect the production of a phenomena of resonance. This resonance then also becomes a component contributing to the increase in hydrodynamic pressure. The resonance of a structure in contact with water can be the most damaging cause of force. The panel apparatus mentioned within this application will help attenuate this resonance and protect the structure.

A structure in contact with water, or submerged such as dam, bridge abutment or submerged tunnel, may be affected by reducing loading onto the structure which is transmitted through the water in the form of stress waves and shock waves. The panels will absorb and attenuate pressure waves and reflect stress waves as rarefracted waves. The panel is comprised of a flexible enclosure or cell, filled with a suitable pressure wave attenuating medium material having a lower acoustic impedance than the water or ground in contact with the panel, in order to reflect shock wave energy. This basic configuration can be mounted in the form of panels and attached directly to the structure, in which case it will form a flexible barrier of low acoustic impedance and be orientated between the structure and the water or ground in contact with the structure. The basic configuration will also protect a structure by placing it "free field" or "far field", a distance from the structure to protect, in which case several containers will be arranged and fixed in an array. The pressure absorbing and attenuating medium that will reflect shock waves may be a gas, compressed air or a porous foam. The flexible enclosure may be a rubber or plastic or elastomer or suitable flexible material. In cases where particular foaming agents are used, an enclosure is not required.

One theme which runs through the embodiments described is to make the environment around a structure (whether the environment is solid or liquid) to be as porous as possible. The terminology of "bubble curtain" is conventional terminology for conventional technology, and it is disclosed herein different embodiments which create the same effect as a bubble curtain.

BRIEF DESCRIPTION OF DRAWINGS

FIGS. 1(*b*), 1(*c*) and 1(*d*) are respectively side views of a panel with various medium.

FIGS. 14(*a*) and 14(*b*) are respectively schematic cross-section and plan views of an array of a fourth embodiment of a bubble curtain.

DESCRIPTION OF THE PREFERRED EMBODIMENTS

Figure 8:
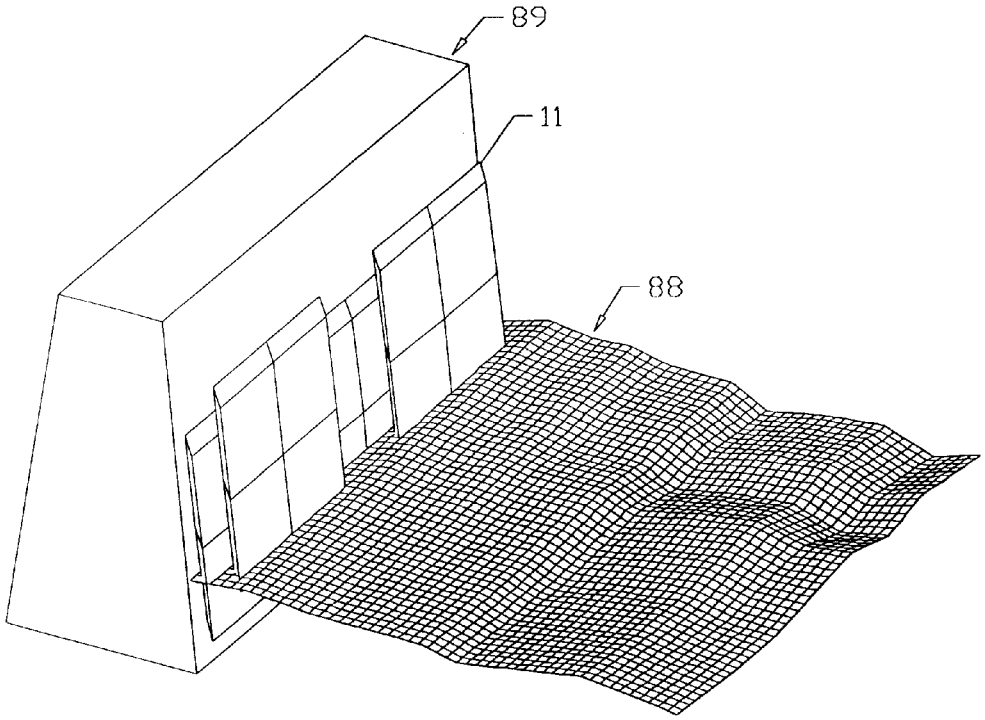
FIG. 8 shows a perspective view of several layers of the panels attached to a structure.

The basic shape of panel 10 is shown in FIG. 1(*a*), and a plurality of panels 10 are connected to cover a structure (for example, a dam), as shown in FIG. 8.

The geometries of panel 10 will be first considered, and then its composition.

Figure 7A:
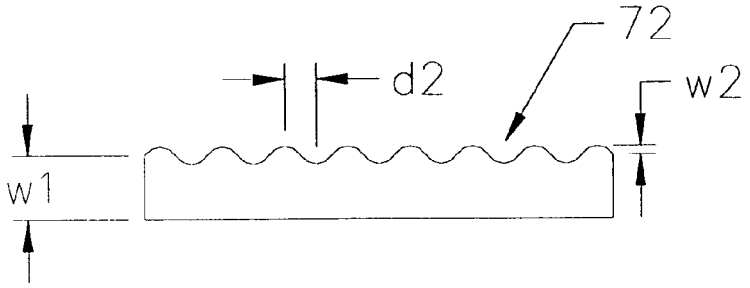
FIGS. 7(*a*) and 7(*b*) are respectively, side and front views of a variation of a panel, showing a corrugated face.
Figure 7B:
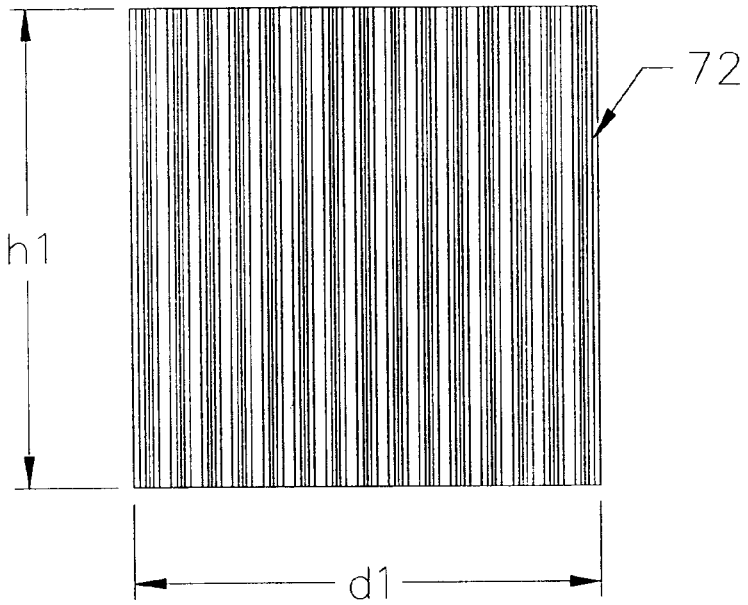

Connecting panels can be achieved in several ways. In FIG. 7 and FIG. 1(*a*), a wedge-type side 11 is shown. Other types of side connections are shown in FIG. 2, 5, 6 and 7. The connections may be profiled in other mating ways as long as the result is a flush surface.

Figure 1A:
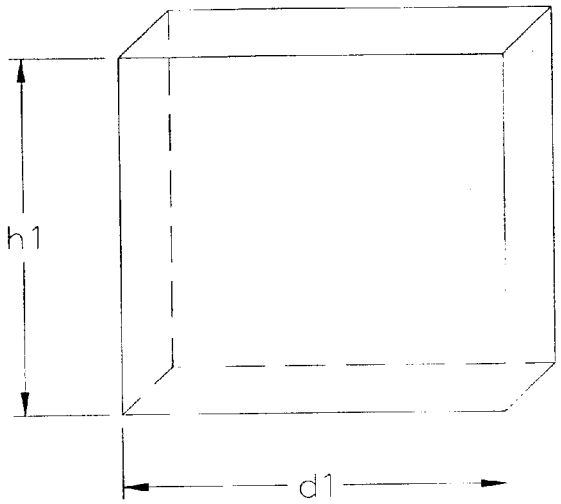
FIG. 1(*a*) is a perspective view of a panel.
Figure 1B:
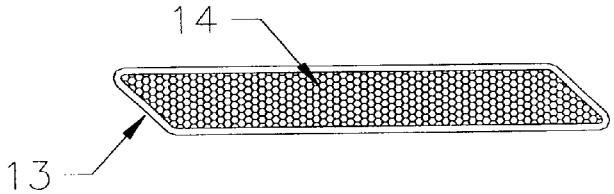
Figure 1C:
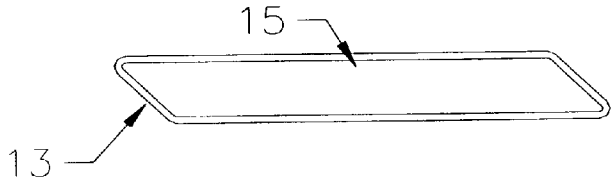
Figure 1D:
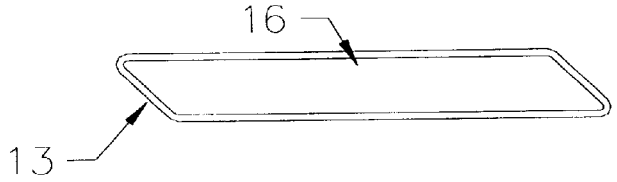
Figure 2A:
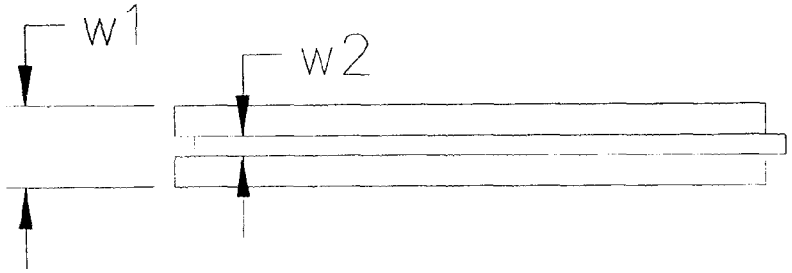
FIGS. 2(*a*) and 2(*b*) are respectively, side and front views of a variation of a panel.
Figure 2B:
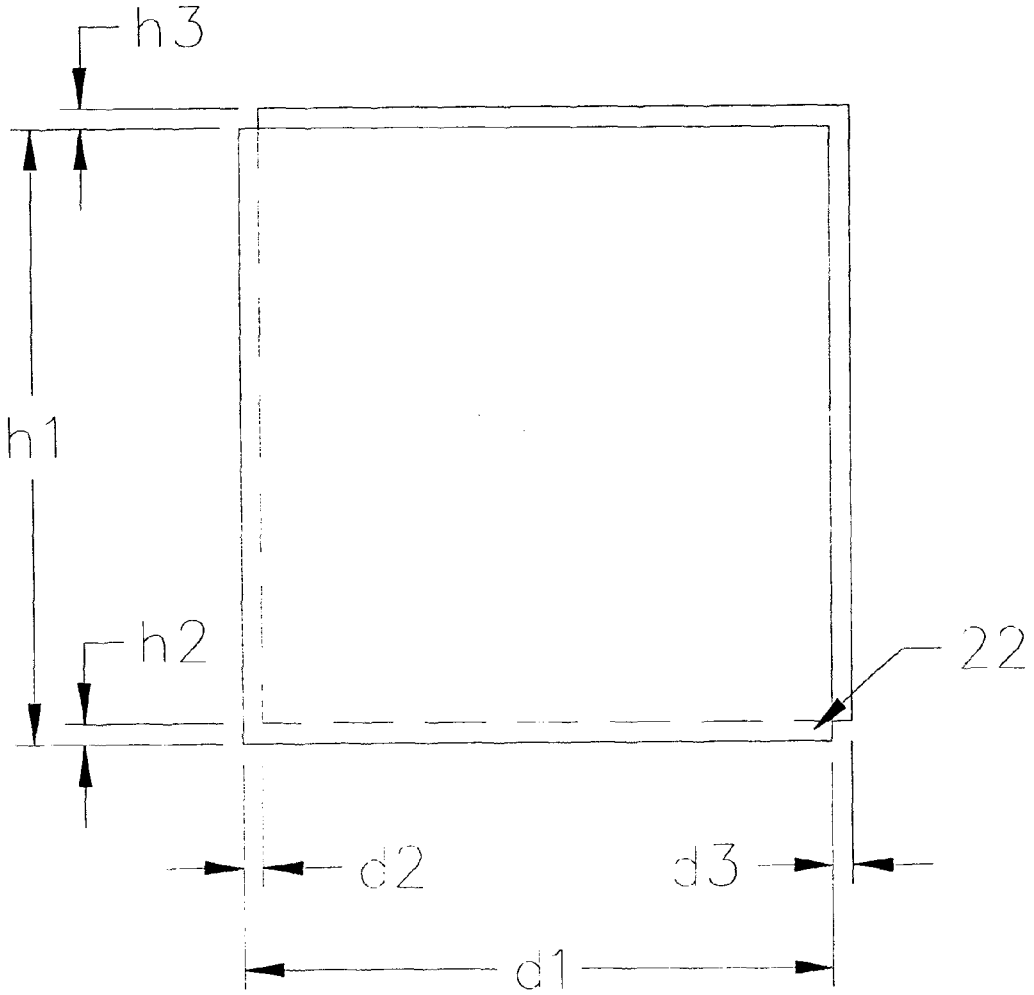
Figure 3A:
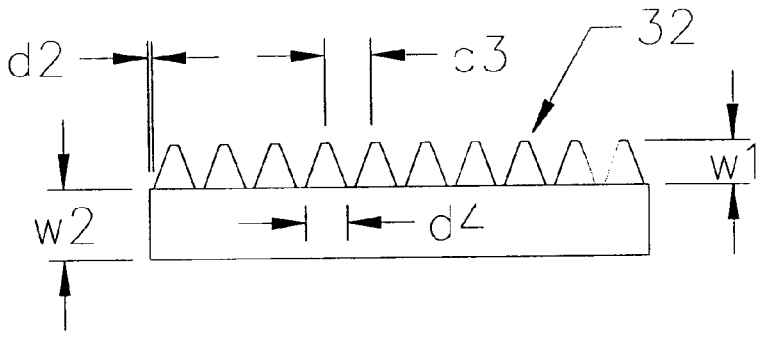
FIGS. 3(*a*) and 3(*b*) are respectively, side and front views of a variation of a panel, showing a projected face.
Figure 3B:
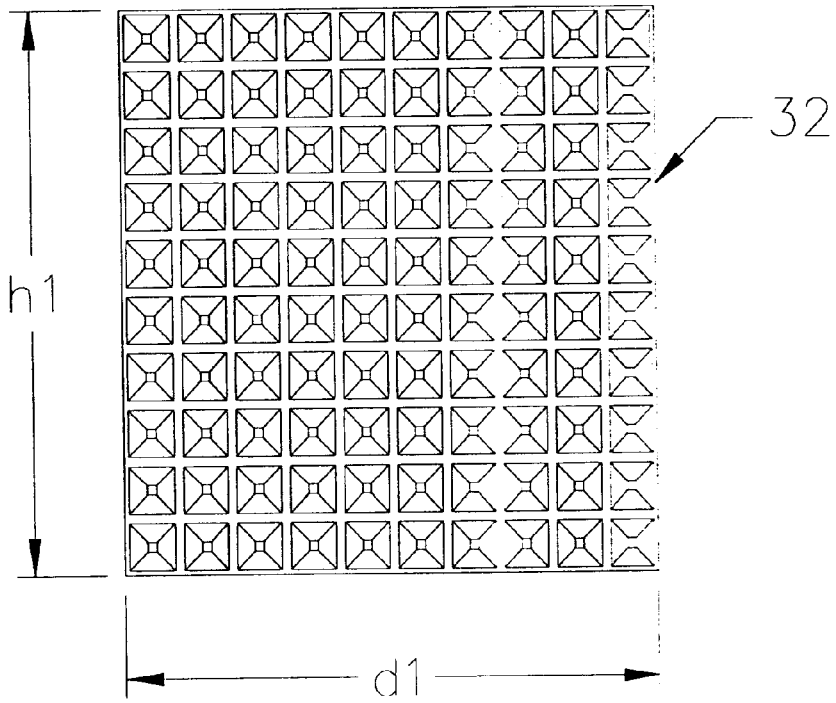
Figure 4A:
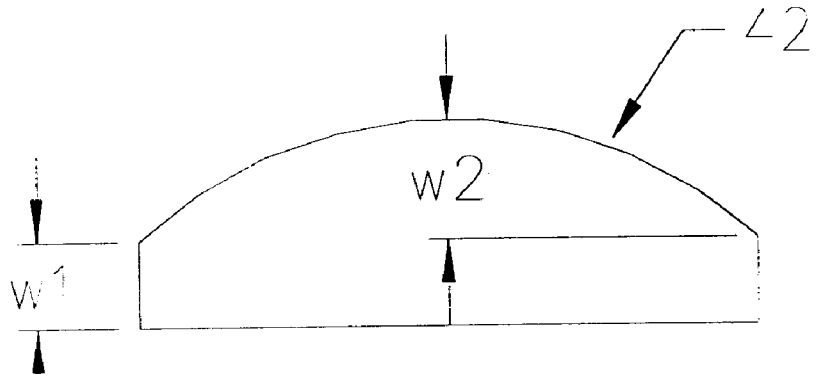
FIGS. 4(*a*) and 4(*b*) are respectively, side and front views of a variation of a panel, showing a convex face.
Figure 4B:
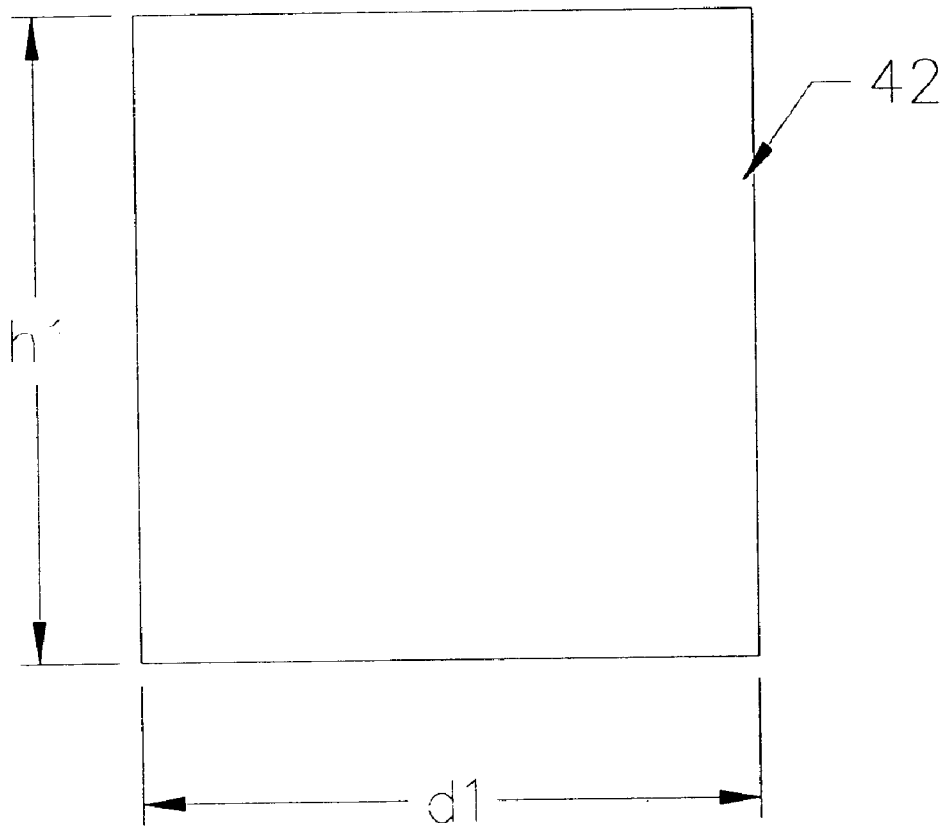
Figure 5A:
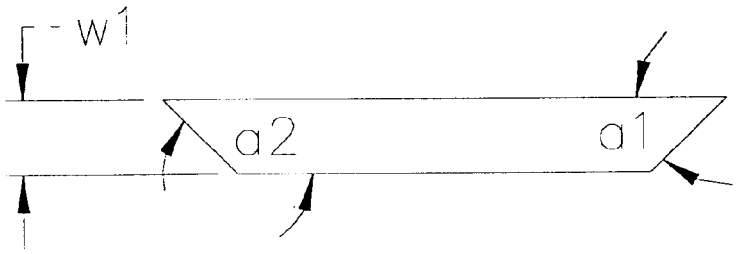
FIGS. 5(*a*) and 5(*b*) are respectively, side and front views of a variation of a panel, showing beveled edges.
Figure 5B:
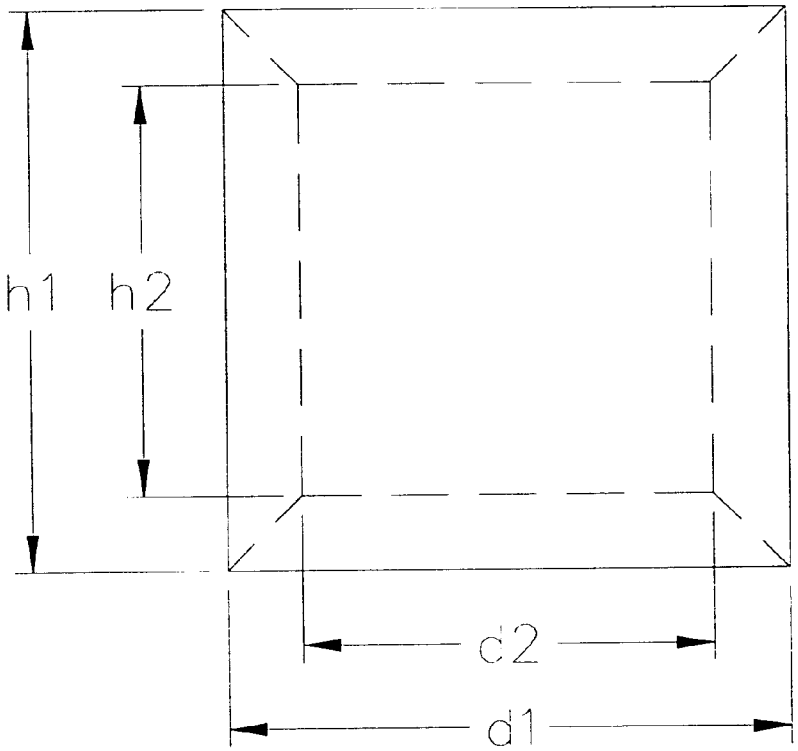
Figure 6A:
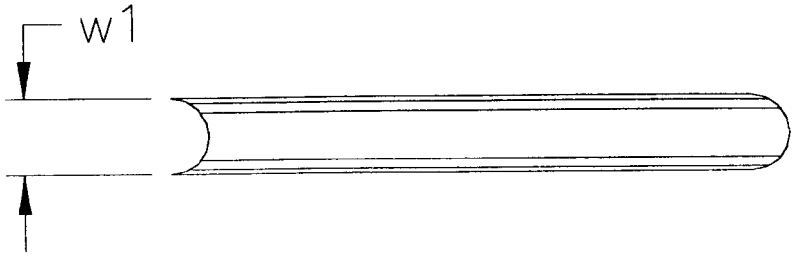
FIGS. 6(*a*) and 6(*b*) are respectively, side and front views of a variation of a panel, showing concave and convex edges.
Figure 6B:
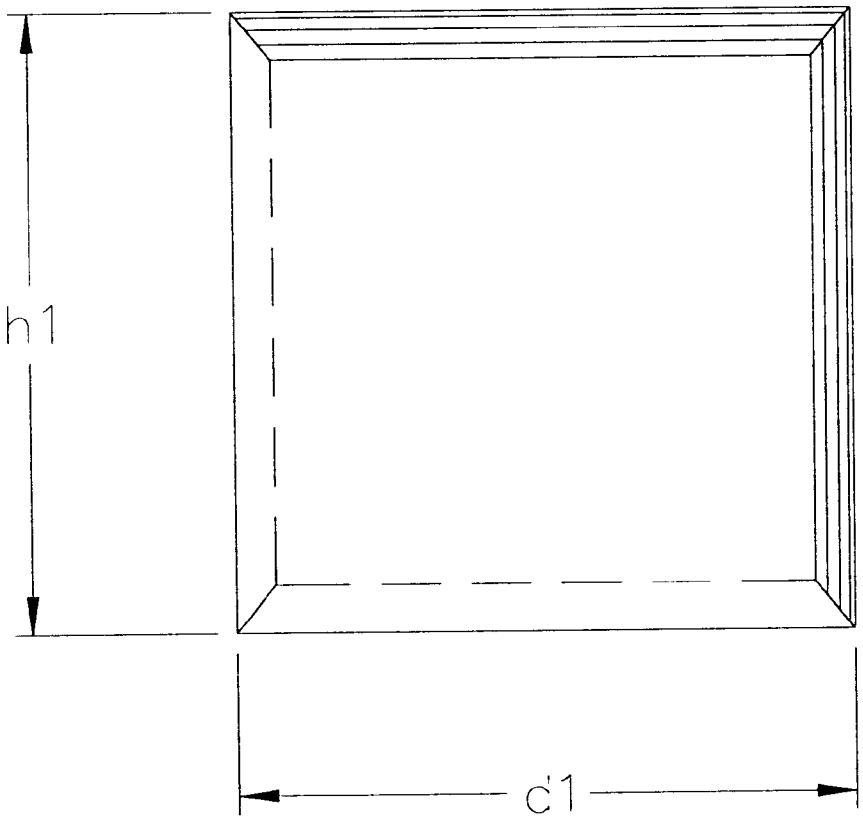

The front surfaces of the panels may be flat (for example, surface 22 in FIG. 2(*b*)) or varied (multiple pyramidal surface 32 in FIG. 3(*b*), convex surface 42 in FIG. 4(*b*) and corrugated surface 72 in FIG. 7(*b*)). The front surface of the panels may be profiled in other similar ways.

Panels 10 may be made of flexible plastic cell or outer shell 13 made by conventional methods. Shell 13 sealingly contains a medium such a porous foam (FIG. 1(*b*), a gas (FIG. 1(*c*), for example, air) or a vacuum (FIG. 1(*d*)). Other mediums are possible, as long as the medium has an acoustic impedance less than that of water. The lower the relative impedance, the more effective the attenuation qualities of the panel.

In FIG. 8, there is shown two layers of panels 11 to provide better protection. The panels 11 of the layer proximate structure 89, are partially embedded in the marine bed 88, to provide resistance against the effects of, for example, currents which may destabilize the panel.

In a variation not shown, a rigid plate (for example, steel) may be advantageously attached to the surface of the panels 10 facing and nearest the structure. Also, a second plate (not shown) may be attached to the outer surface of the panel 11 farthest away from structure 89. The second plate may be made of plastic of sufficient durability to protect the panels from floating debris and the like, as long as it's acoustic impedance is similar to that of water.

Figure 9:
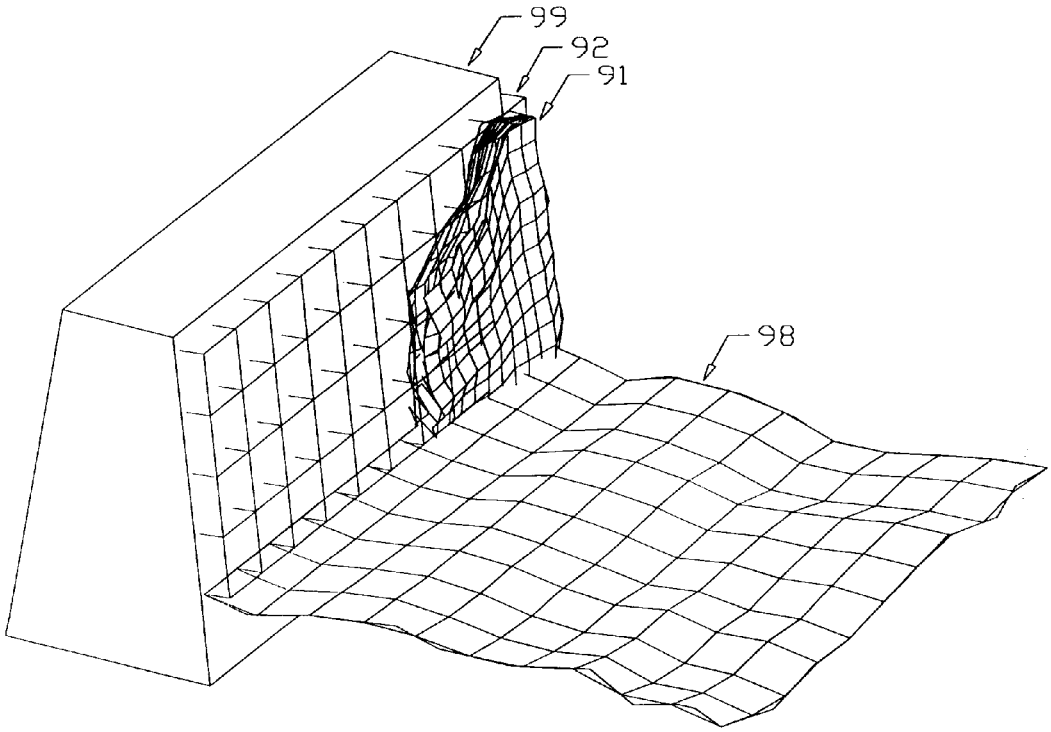
FIG. 9 shows a variation of a panel.

A variation of the panel is shown in FIG. 9, where 99 is the structure to be protected, 98 is the marine bed, and 92 is a wire or support mesh attached to structure 99. For certain types of material which will harden naturally into a flexible outer shell enclosing the porous foam (for example, spraying binary polyurethane foam), it is not necessary to have a discrete shell as those illustrated in FIGS. 1–8. A worker will spray the foam onto mesh 92, which will harden into a panel without a discrete enclosure holding the medium.

Another way of creating the effect of the panels described above, is to create a bubble curtain, which can take various forms.

Figure 10A:
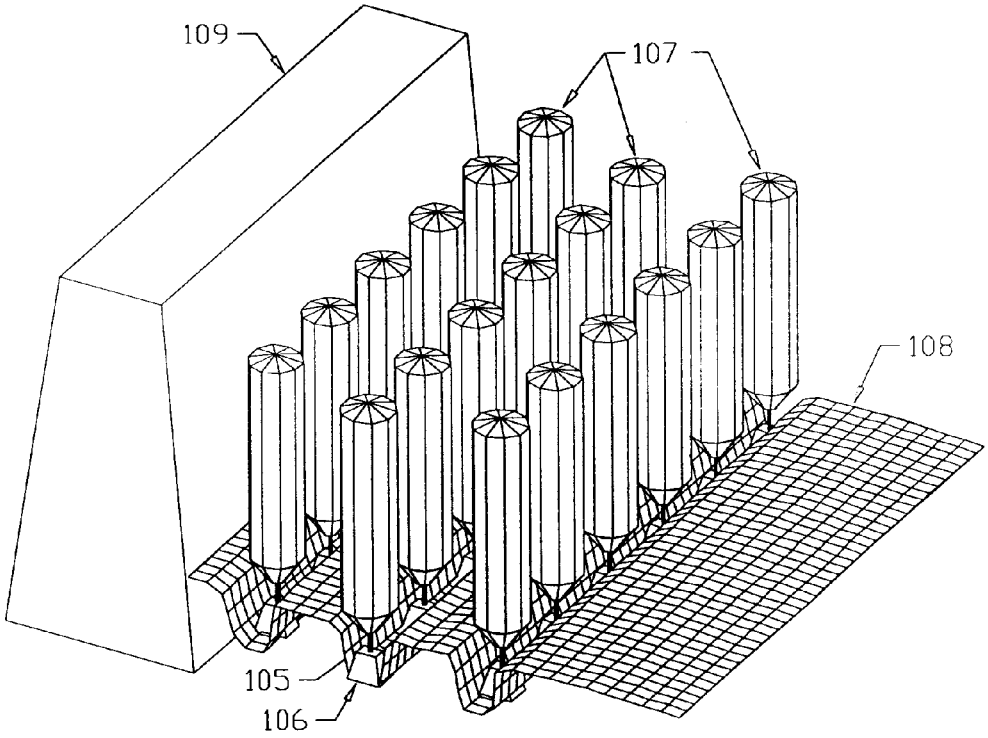
FIGS. 10(*a*) and 10(*b*) show respectively a perspective and top view of an array for a first embodiment of a bubble curtain.
Figure 10B:
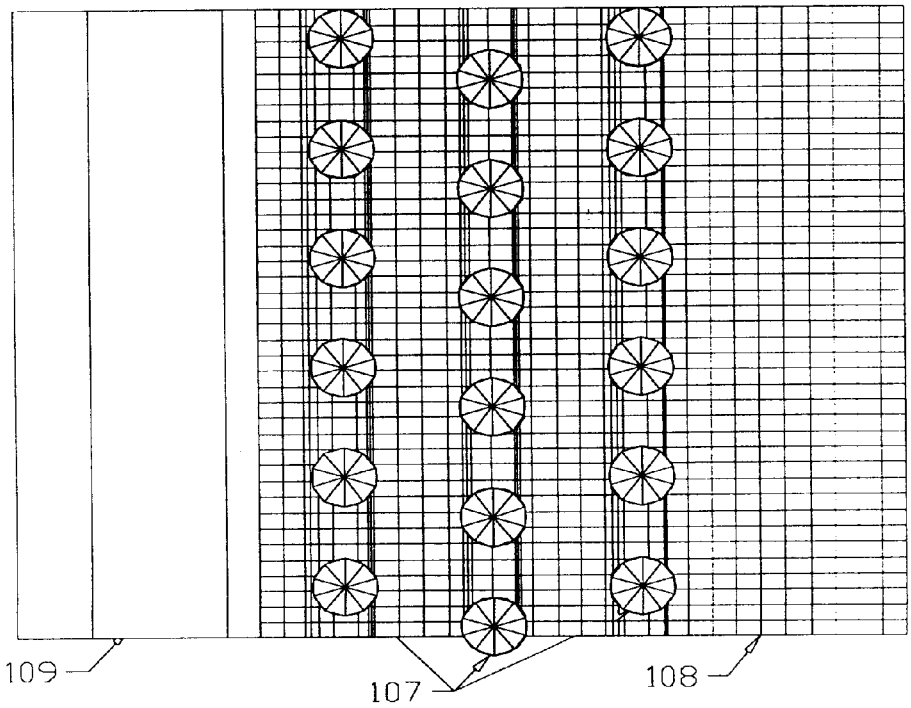

FIGS. 10(*a*) and 10(*b*) show an array of containers 107 aligned in front of structure 109. Containers 107 may be substantially cylindrical, but other variations are possible. For purposes of this document, "substantially cylindrical" covers generally columnar or prismatic shapes, whether they are, in cross section, for example, circular, elliptical, star-shaped, pentagon, rectangular or square.

The geometry may be selected based on manufacturing considerations. While one row of containers 107 will be advantageous, several rows will be more advantageous, especially if the rows of containers 107 are offset, as seen from the point of view of an approaching wave, as shown in FIG. 10(*b*). In this document, "irregular" refers to any configuration which is not uniform, such as the offset patterns of FIG. 8 and FIG. 10, or something more random.

The containers are suspended in the water proximate structure 109, anchored by anchors 106 which are by lines 105, which may be flexible cord or a rigid rod.

The manufacture of the container may use rotationally molded polyethyline plastics, cavity molded polyurethane elastomier resins or other suitable flexible material. Plastic piping or tubes with end caps would also be suitable.

Figure 11:
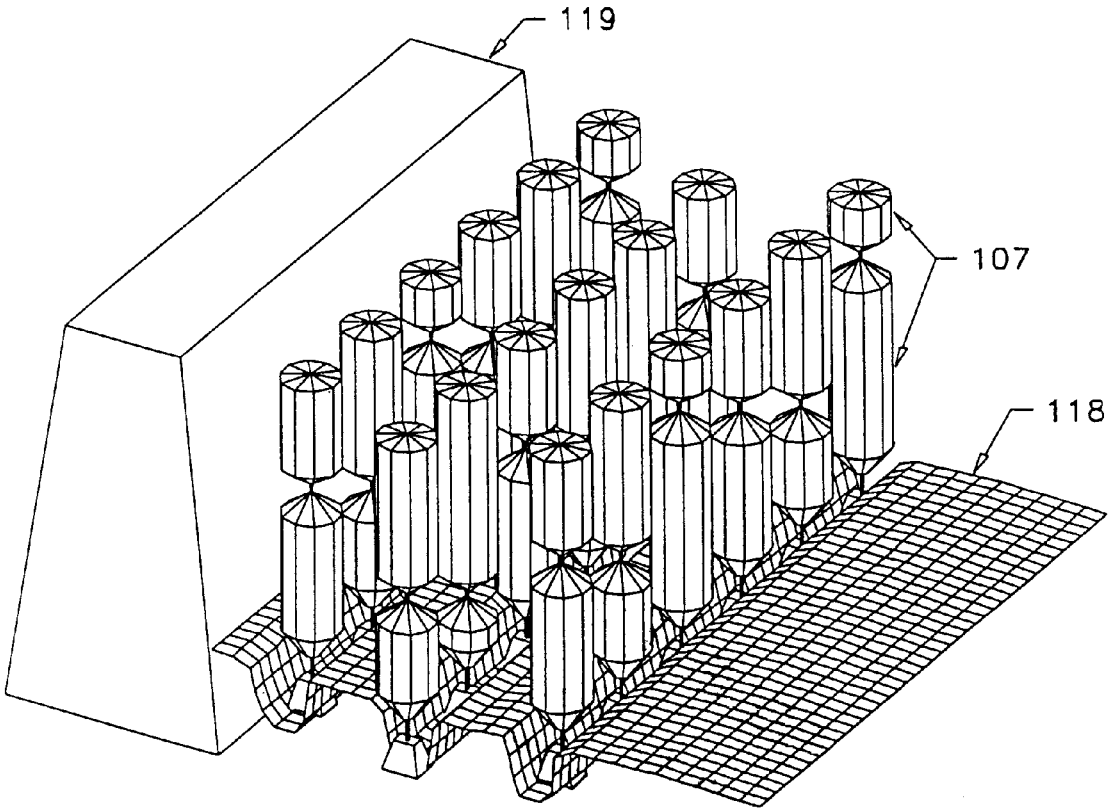
FIG. 11 is a perspective view of a variation of the bubble curtain of FIG. 10.

Containers may take other configurations, while remaining substantially cylindrical. For example, a combination of smaller containers 107 is shown in FIG. 11. Spherical containers are possible (not shown).

Figure 12:
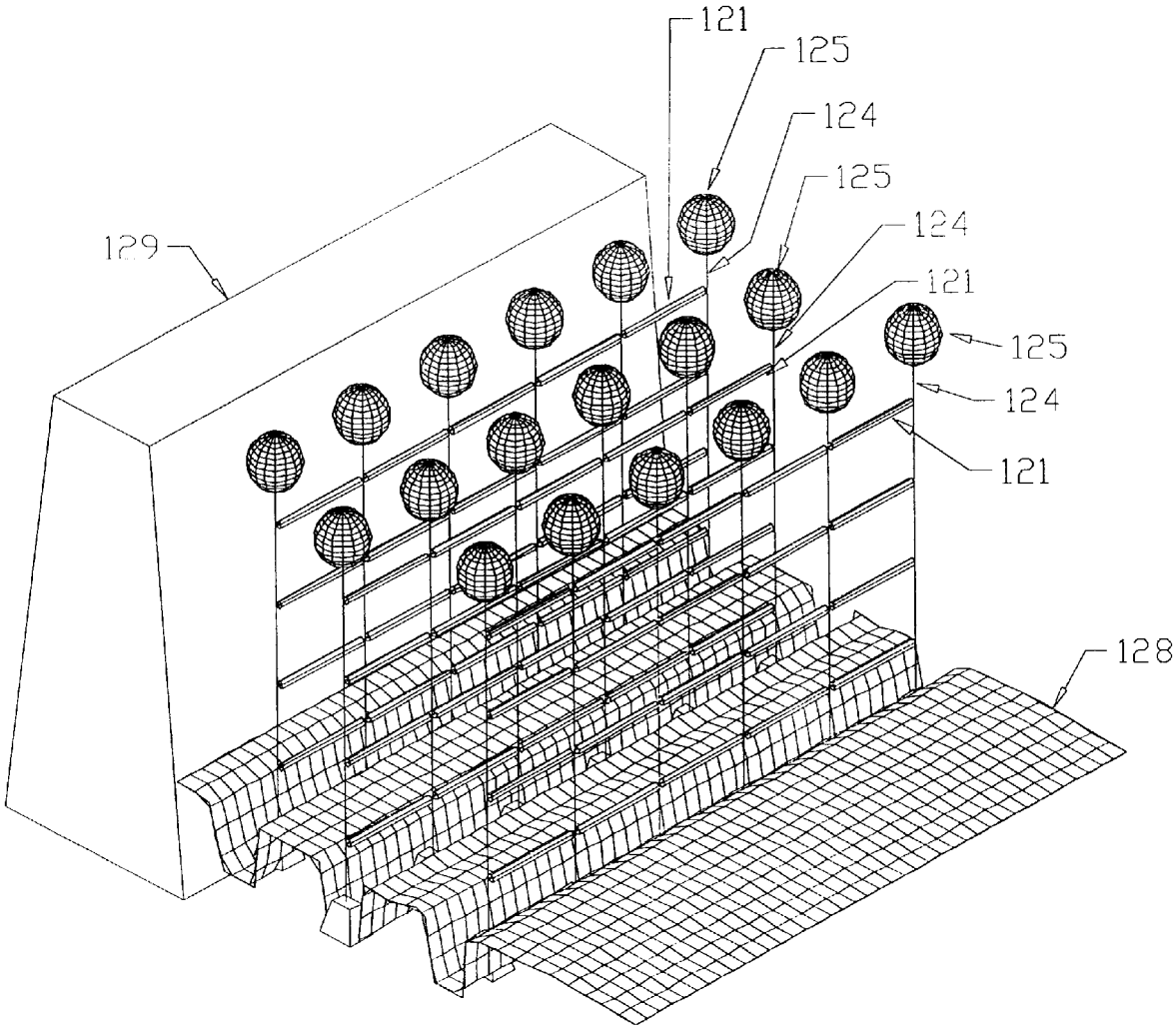
FIG. 12. is a perspective view of a second embodiment of a bubble curtain.
Figure 13:
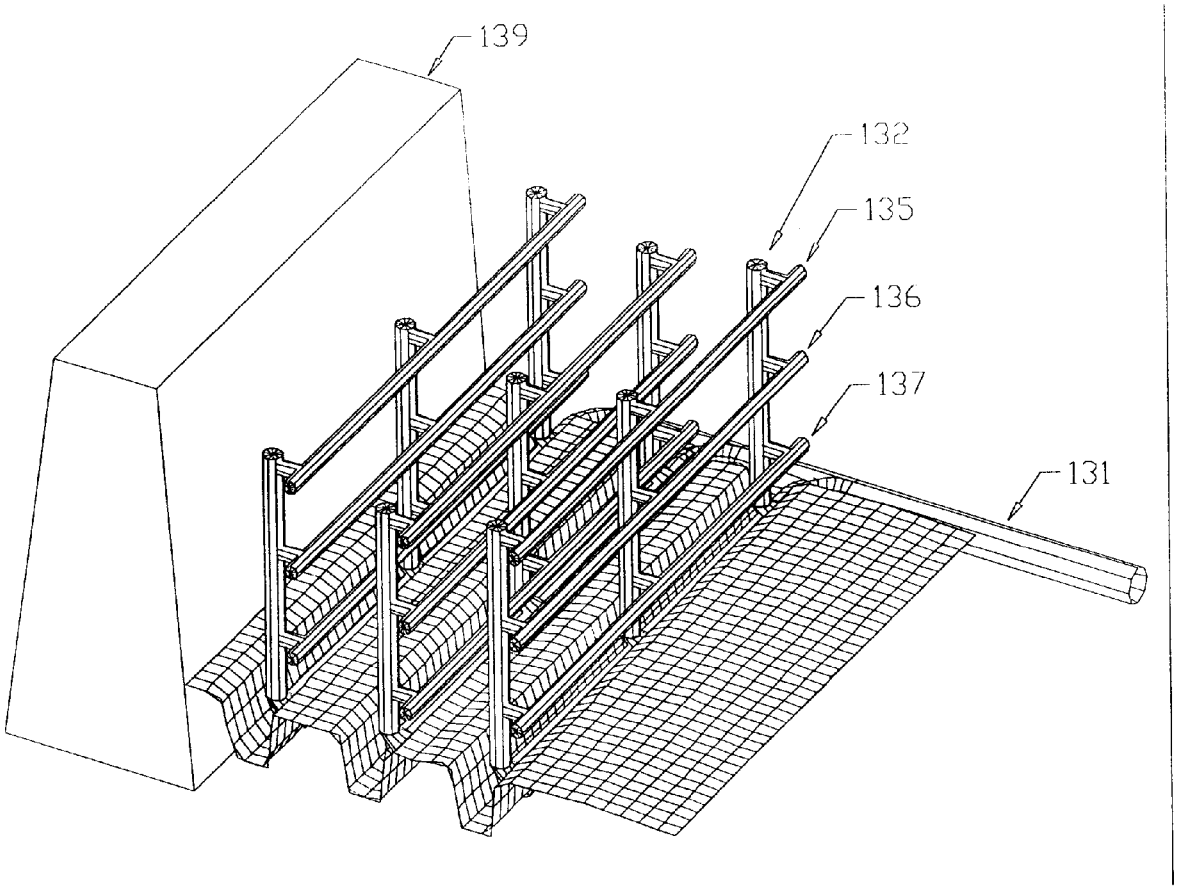
FIG. 13 is a perspective view of a third embodiment of a bubble curtain.

Other embodiments of the bubble curtain are shown in FIG. 12 and 13. In FIG. 12, an array of underwater flares 121 are suspended in the water in front of structure 129 by means of conventional floats 125 and lines 124. Alternative more rigid supporting structures are possible by conventional scaffolding.

The flares 121 are conventional and are activated conventionally (for example, by electric means not shown). A conventional seismic sensor (not shown) is placed remotely of structure 129 for early detection of seismic waves approaching.

Upon detection of, for example, P-waves of a certain magnitude, a signal would be sent by the sensor, which would be processed to ignite flares 121 by conventional means.

Another embodiment of a bubble curtain is shown in FIG. 13. A ladder-like pipe assembly 132 comprises three horizontal rungs, 135, 136 and 137. Pipe assembly 132 receives gas from a gas pumping station (not shown) through pipe 131. Each rung 135, 136 and 137 has outlets (not shown) along its length for gas to exit and rise. Upon activation of the gas pumping station (perhaps by human activation or automatically upon the appropriate signal from a remote seismic sensor, as that described for FIG. 12), the pipe assembly 132 will activate and create a bubble curtain. The pumping station would presumably be well stocked and could run for long periods of time, to protect against aftershocks.

The vertical separation between rungs 135, 136 and 137 is determined by the speed of the rise of the bubbles to the water surface (which partially depends on features like the pressure of the gas and presence of nozzles) and the difference in the expected times of arrival at structure 139 of the (earlier) P-Wave and the (later) S-Waves. By conventional calculation and tuning, the vertical separations between the rungs may be arranged so that bubbles from a lower rung will rise to the level of the rung immediately above it. The effect of assembly 132 is therefore, a complete bubble curtain to meet the first S-waves.

Because waves can come also through the ground, the bubble curtain concept may be extended to the ground.

In FIG. 14(*a*), structure 149 is embedded in landmass 148 and holds back water 147. Landmass 148 includes both the marine bed downstream and the ground upstream of structure 149. Containers 141, 142 and 143 (of substantially cylindrical profile) are embedded in landmass 148. For those portions of landmass 148 which are below water, the upper parts of containers 141 and 143 may rise above the surface of the landmass 148 (not shown). For landmass 148 whose surface is air, containers will typically remain completely embedded. Containers 142 are directed toward a point approximately vertically below structure 149. FIG. 14(*b*) is a plan view showing structure 149 in relation to a plurality of containers 141, 142 and 143.

Manufatgure.

A combination of the above embodiments is best to protect a structure. A sensor would detect the arrival of P-waves, which would immediately activate the deflagration units of FIG. 12 to create an immediate bubble curtain and start the bubbling units of FIG. 13. Containers, such as those of FIG. 10(*a*) and the panels will be ready to receive the oncoming waves.

Although it is best that the entire structure be cushioned with the application of this invention, it may be tolerable in some situations to cushion only part. For example, a dam have certain sensitive portions and only those portions would be cushioned.

While the main application of the invention lies with structures having a submarine portion, the principles of this application may be applied to subterranean chamber (for example, a bomb shelter). A plurality of the type of containers shown in FIG. 14, may used to completely surround the chamber.

It will be apparent that modification and variation may be made to the embodiments disclosed without departing from the invention. For example, if the structure is curved, such as an underground cable, then the panels may be formed in a shape to fit in a circumjacent relationship to the structure.

I claim:

1. A cushion for a ground-based structure having a submarine portion, comprising attenuation means, positioned submarine and proximate to a submarine portion of the structure, for attenuating the effects of hydrodynamic pressures from a violent origin containing a medium with an acoustic impedance lower than that of water, wherein said attenuation means includes:

a plurality of panels each filled with said medium connected to form a first layer of panels in a substantially close fitting relationship to the submarine portion of the structure; and a second layer of connected panels which is disposed outwardly of said first layer.

2. A cushion of claim 1, wherein each panel of said first layer is attached securely to a proximate panel of said second layer.

3. A cushion of claim 2, wherein a panel beside the submarine portion of the structure has attached to its face beside the submarine portion, a rigid plate.

4. A cushion of claim 3, wherein a panel remotest from the submarine portion, has an outer surface which has a convex part.

5. A cushion of claim 4, wherein a panel remotest from the submarine portion, has an outer surface which has a concave part.

6. A cushion of claim 5, wherein a panel remotest from the submarine portion, has a plate on its remote face that has an acoustic impedance similar to that of water.

7. A cushion of claim 6, wherein abutting edges of adjacent panels in a layer are profiled in a complementary way to create a flush surface.

8. A cushion of claim 7, wherein said plurality of panels are arranged in an irregular pattern.

9. A cushion of claim 8, wherein said panel is composed of a flexible enclosure containing said medium. bubbles in front of the submarine portion of the structure.

10. A cushion for a ground-based structure having a submarine portion, comprising attenuation means, positioned submarine and proximate to a submarine portion of the structure, for attenuating the effects of hydrodynamic pressures from a violent origin, containing a medium with an acoustic impedance lower than that of water, wherein said attenuation means includes a plurality of panels each filled with said medium, and at least one of said panels is composed of a closed cell foaming agent being sprayed onto and formed on a supporting mesh which is attached to the structure.

* * * * *